US008672821B1

(12) United States Patent
Pearce

(10) Patent No.: US 8,672,821 B1
(45) Date of Patent: Mar. 18, 2014

(54) PAINT ROLLER CLEANER AND ASSOCIATED METHOD

(76) Inventor: Neil Frederick Pearce, Enfeild (GB)

( * ) Notice: Subject to any disclaimer, the term of this patent is extended or adjusted under 35 U.S.C. 154(b) by 268 days.

(21) Appl. No.: 13/286,140

(22) Filed: Oct. 31, 2011

Related U.S. Application Data

(60) Provisional application No. 61/407,930, filed on Oct. 29, 2010.

(51) Int. Cl.

| | |
|---|---|
| ***B05C 1/08*** | (2006.01) |
| ***B08B 3/00*** | (2006.01) |
| ***A46B 15/00*** | (2006.01) |
| ***B05C 17/02*** | (2006.01) |

(52) U.S. Cl.
USPC ..... 492/15; 134/138; 134/115 R; 134/137; 134/153; 134/198; 134/900; 15/105; 15/230.11; 492/17; 492/60

(58) Field of Classification Search
USPC ..... 492/15, 17, 24, 60; 134/115 R, 138, 134/135, 900, 153, 147, 172, 178, 198, 38, 134/137, 151, 103.2, 201, 184, 157; 15/105, 230.11
See application file for complete search history.

(56) References Cited

U.S. PATENT DOCUMENTS

| | | | | | |
|---|---|---|---|---|---|
| 3,421,527 | A * | 1/1969 | Dettman | 134/138 |
| 4,641,673 | A * | 2/1987 | Conley et al. | 134/138 |
| 4,809,722 | A * | 3/1989 | Pennise | 134/138 |
| 5,005,598 | A * | 4/1991 | Hodgdon | 134/138 |
| 5,095,928 | A * | 3/1992 | Phipps | 134/138 |
| 5,238,012 | A * | 8/1993 | Coronato | 134/140 |
| 5,402,808 | A * | 4/1995 | Wallis et al. | 134/104.2 |
| 5,409,027 | A * | 4/1995 | Glunt | 134/138 |
| 5,413,133 | A * | 5/1995 | Russell | 134/138 |
| 5,487,399 | A * | 1/1996 | Hannah | 134/138 |
| 5,544,668 | A * | 8/1996 | Dollar | 134/104.2 |
| 5,626,158 | A * | 5/1997 | Gratopp | 134/138 |
| 5,839,459 | A * | 11/1998 | Bisby | 134/138 |
| 6,019,111 | A * | 2/2000 | Gillies | 134/138 |
| 6,408,862 | B1 * | 6/2002 | van Rooyen | 134/138 |
| 6,578,590 | B2 * | 6/2003 | Leblond | 134/99.2 |
| 7,383,847 | B2 * | 6/2008 | Clark | 134/148 |
| 7,845,363 | B2 * | 12/2010 | Dominey | 134/198 |
| 8,449,693 | B2 * | 5/2013 | Sheffield | 134/115 R |
| 8,505,562 | B2 * | 8/2013 | McPhee, III | 134/198 |
| 2001/0047818 | A1 * | 12/2001 | Bastien | 134/138 |
| 2002/0166578 | A1 * | 11/2002 | Leblond | 134/99.2 |
| 2006/0016464 | A1 * | 1/2006 | Dominey | 134/201 |

(Continued)

FOREIGN PATENT DOCUMENTS

GB 2344749 A * 6/2000 ..... B44D 3/00

*Primary Examiner* — Essama Omgba

(57) ABSTRACT

A combined paint roller and paint roller cleaner quickly and efficiently removes paint from the paint roller cleaner while preventing fluids from splashing outwardly and away from the paint roller cleaner. The paint roller cleaner includes a main chamber having a first slot formed at an outer surface thereof, and an auxiliary chamber statically coupled to the main chamber. Such an auxiliary chamber protrudes outwardly from the outer surface of the main chamber and preferably has an outer surface provided with a second slot formed therein. Notably, the second slot may be offset from the first slot in such a manner that an external fluid stream, after passing through the first and second slots, is caused to enter the main chamber at a non-perpendicular angle relative to the outer surface of the main chamber and thereby rotate a portion of the paint roller located within the paint roller cleaner.

19 Claims, 5 Drawing Sheets

(56) References Cited

U.S. PATENT DOCUMENTS

| | | | | |
|---|---|---|---|---|
| 2006/0048804 | A1* | 3/2006 | Walter | 134/198 |
| 2006/0243309 | A1* | 11/2006 | Prescott et al. | 134/33 |
| 2007/0089765 | A1* | 4/2007 | Clark | 134/103.2 |
| 2008/0035185 | A1* | 2/2008 | Baratta | 134/137 |
| 2008/0072932 | A1* | 3/2008 | Nicholas | 134/34 |
| 2008/0078429 | A1* | 4/2008 | Hoffmann | 134/178 |
| 2009/0014040 | A1* | 1/2009 | Leblond | 134/157 |
| 2011/0041880 | A1* | 2/2011 | Sheffield | 134/115 R |
| 2012/0037194 | A1* | 2/2012 | Suydam | 134/198 |
| 2012/0080062 | A1* | 4/2012 | Parker et al. | 134/198 |
| 2013/0152980 | A1* | 6/2013 | Hues | 134/36 |
| 2013/0220388 | A1* | 8/2013 | Egan | 134/138 |

* cited by examiner

PAINT ROLLER CLEANER AND ASSOCIATED METHOD

CROSS REFERENCE TO RELATED APPLICATIONS

This application claims the benefit of U.S. Provisional Application No. 61/407,930, filed Oct. 29, 2010, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to paint rollers and, more particularly, to an improved paint roller cleaner for providing a user with a convenient and effective means of cleaning paint rollers.

2. Prior Art

While paint brushes remain a vital tool for decorating purposes, when decorating large flat expanses such as walls and ceilings, it has become more common to use paint rollers. Such paint rollers have the advantage that they retain more paint, requiring less replenishment of the paint upon the roller than would be required on a brush and, due to their size, they enable the painting of large flat expanses very quickly and easily. However, while the cleaning of a paint brush is relatively simple, immediately after use, the cleaning of a paint roller is more difficult. This is because, unlike the bristles of a paint brush, the body of a paint roller is absorbent.

The usual method of cleaning a paint roller, at present, is to rinse the roller in a source of running water, usually under a tap. Paint is washed from the roller by the water although embedded paint usually has to be removed by hand, particularly by squeezing the roller to expel the paint from the body of the roller. This is a time-consuming and inefficient task, as well as a messy one.

Accordingly, a need remains for an apparatus in order to overcome the above-noted shortcomings. The present invention satisfies such a need by providing a paint roller cleaner that is convenient and easy to use, lightweight yet durable in design, versatile in its applications, and designed for providing a user with an effective means of easily cleaning a used paint roller.

BRIEF SUMMARY OF THE INVENTION

In view of the foregoing background, it is therefore an object of the non-limiting exemplary embodiments to provide a combined paint roller and paint roller cleaner for quickly and efficient removing paint from the paint roller cleaner while preventing fluids from splashing outwardly and away from the paint roller cleaner. These and other objects, features, and advantages of the invention are provided by a combined paint roller and paint roller cleaner preferably including a portable paint roller cleaner and a paint roller removably inserted into the paint roller cleaner.

In a non-limiting exemplary embodiment, the paint roller cleaner preferably includes a main chamber having a first slot formed at an outer surface thereof, and an auxiliary chamber statically coupled to the main chamber. Such an auxiliary chamber protrudes outwardly from the outer surface of the main chamber and preferably has an outer surface provided with a second slot formed therein. Notably, the second slot may be offset from the first slot in such a manner that an external fluid stream, after passing through the first and second slots, is caused to enter the main chamber at a non-perpendicular angle relative to the outer surface of the main chamber and thereby rotate a portion of the paint roller located within the paint roller cleaner. Each of the main and auxiliary chambers may have a hollow interior.

In a non-limiting exemplary embodiment, the main chamber may have a closed distal end and an open proximal end.

In a non-limiting exemplary embodiment, the paint roller preferably includes a handle, a support frame attached to the handle, and a roller head removable engaged about the support frame. In this manner, the support frame and the roller head may be inserted into the main chamber and spaced inwardly from the auxiliary chamber.

In a non-limiting exemplary embodiment, the main chamber may have a single and unitary body.

In a non-limiting exemplary embodiment, the main chamber may have a bifurcated body provided with first and second halves pivotally coupled to each other.

In a non-limiting exemplary embodiment, the paint roller cleaner may further include first and second planar plates statically coupled to the first and second halves respectively. Such first and second planar plates may be registered parallel to each other and extend outwardly away from the main chamber. In this manner, the handle is intercalated between the first and second plates and thereby maintained at a substantially stable position while the roller head is disposed within the main chamber.

In a non-limiting exemplary embodiment, the first and second slots may be linear and extend parallel to a longitudinal length of the main and auxiliary chambers respectively.

In a non-limiting exemplary embodiment, the auxiliary chamber may be closed distal and proximal ends respectively for directing the fluid into the main chamber via the first slot.

In a non-limiting exemplary embodiment, the roller head is preferably caused to rotate within the main chamber during cleaning procedures while the handle remains stationary.

In a non-limiting exemplary embodiment, an exemplary embodiment of the present disclosure may include a method of utilizing a combined paint roller and paint roller cleaner. Such a method may include the initial step of: providing a portable paint roller cleaner having a main chamber provided with a first slot formed at an outer surface thereof, and an auxiliary chamber statically coupled to the main chamber. Such an auxiliary chamber protrudes outwardly from the outer surface of the main chamber and has an outer surface provided with a second slot formed therein. Each of the main and auxiliary chambers preferably has a hollow interior. A second chronological step may include: providing and removably inserting the paint roller into the paint roller cleaner. Notably, the second slot is offset from the first slot in such a manner that an external fluid stream, after passing through the first and second slots, is caused to enter the main chamber at a non-perpendicular angle relative to the outer surface of the main chamber and thereby rotate a portion of the paint roller located within the paint roller cleaner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
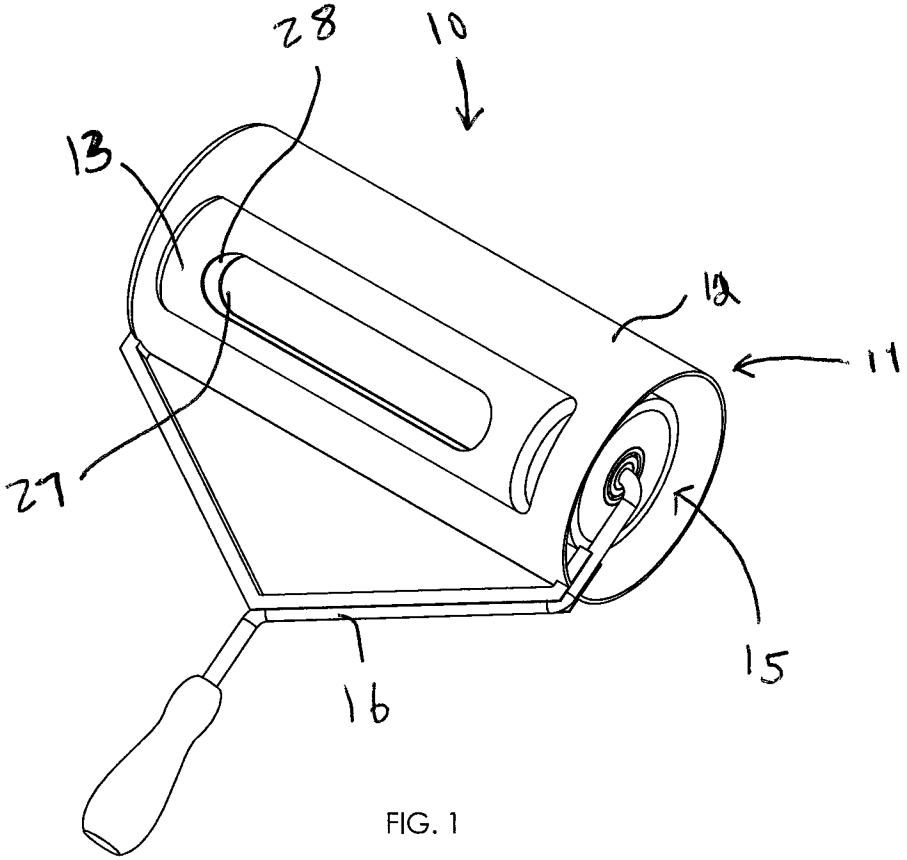
FIG. 1 is a perspective view showing a combined paint roller and paint roller cleaner, in accordance with a non-limiting exemplary embodiment.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The non-limiting exemplary embodiments will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "non-limiting exemplary embodiments" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the non-limiting exemplary embodiments. Thus, to the maximum extent allowed by law, the scope of the non-limiting exemplary embodiments is to be determined by the broadest permissible interpretation of the following claims and their equivalents, and shall not be restricted or limited by the foregoing detailed description.

References in the specification to "one embodiment", "a non-limiting exemplary embodiment", "a preferred embodiment", "an alternative embodiment" and similar phrases mean that a particular feature, structure, or characteristic described in connection with the embodiment is included in at least an embodiment of the invention. The appearances of the phrase "non-limiting exemplary embodiment" in various places in the specification are not necessarily all meant to refer to the same embodiment.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

Figure 2:
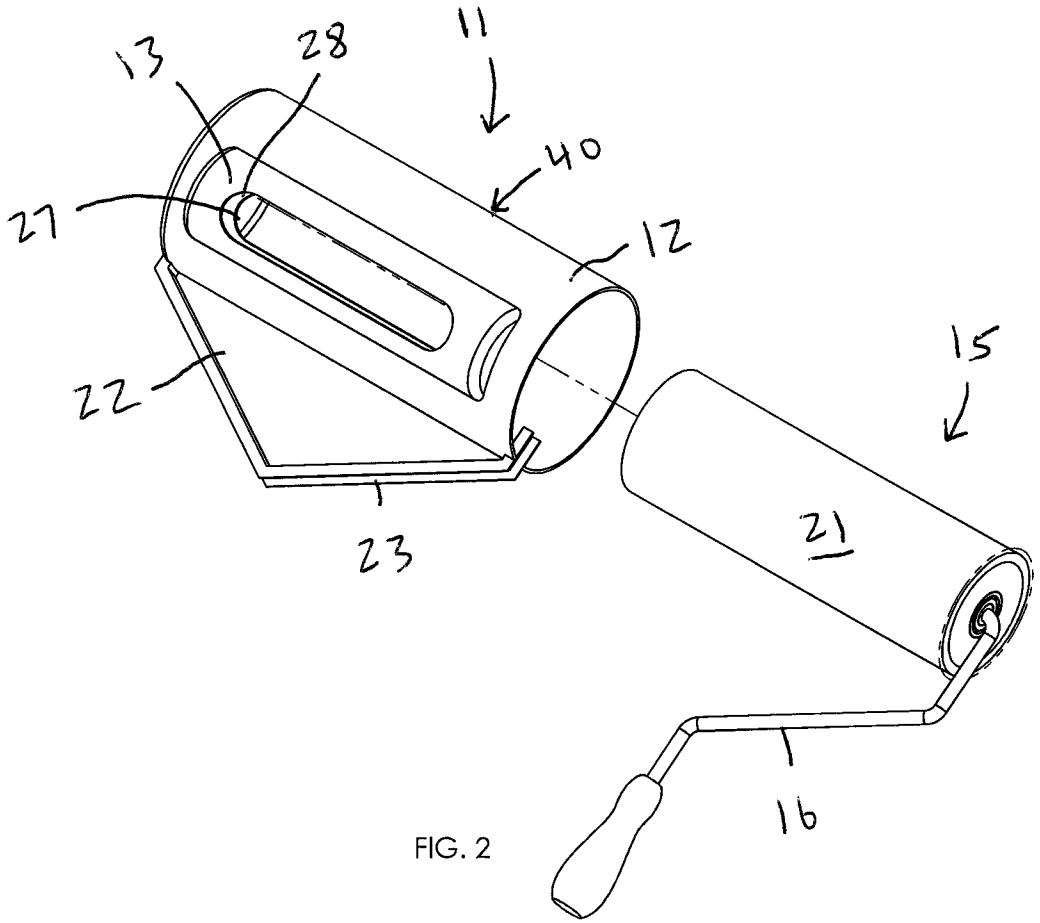
FIG. 2 is an exploded view of the combined paint roller and paint roller cleaner shown in FIG. 1.
Figure 3:
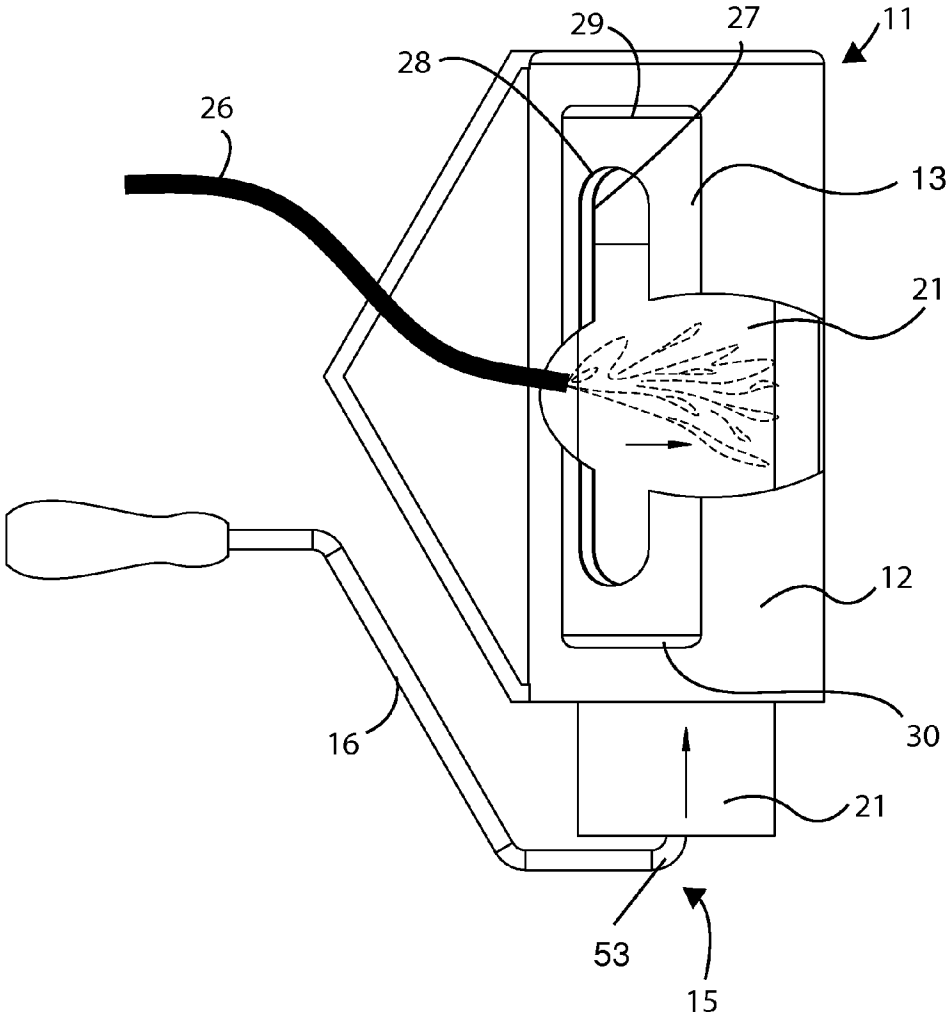
FIG. 3 is a partial broken view showing the tangential travel path of the fluid splashing against the paint roller head after passing through the first and second slots.
Figure 4:
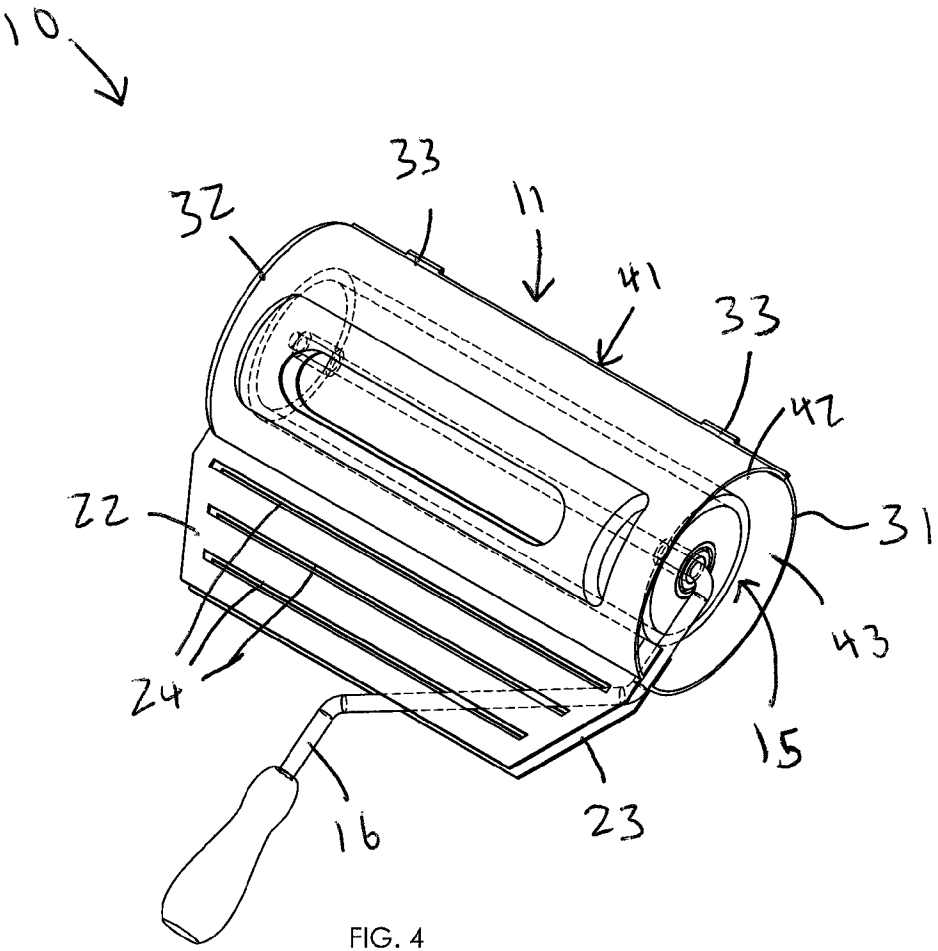
FIG. 4 is a transparent view showing the interrelationship between the main chamber and paint roller head inserted therein.
Figure 5:
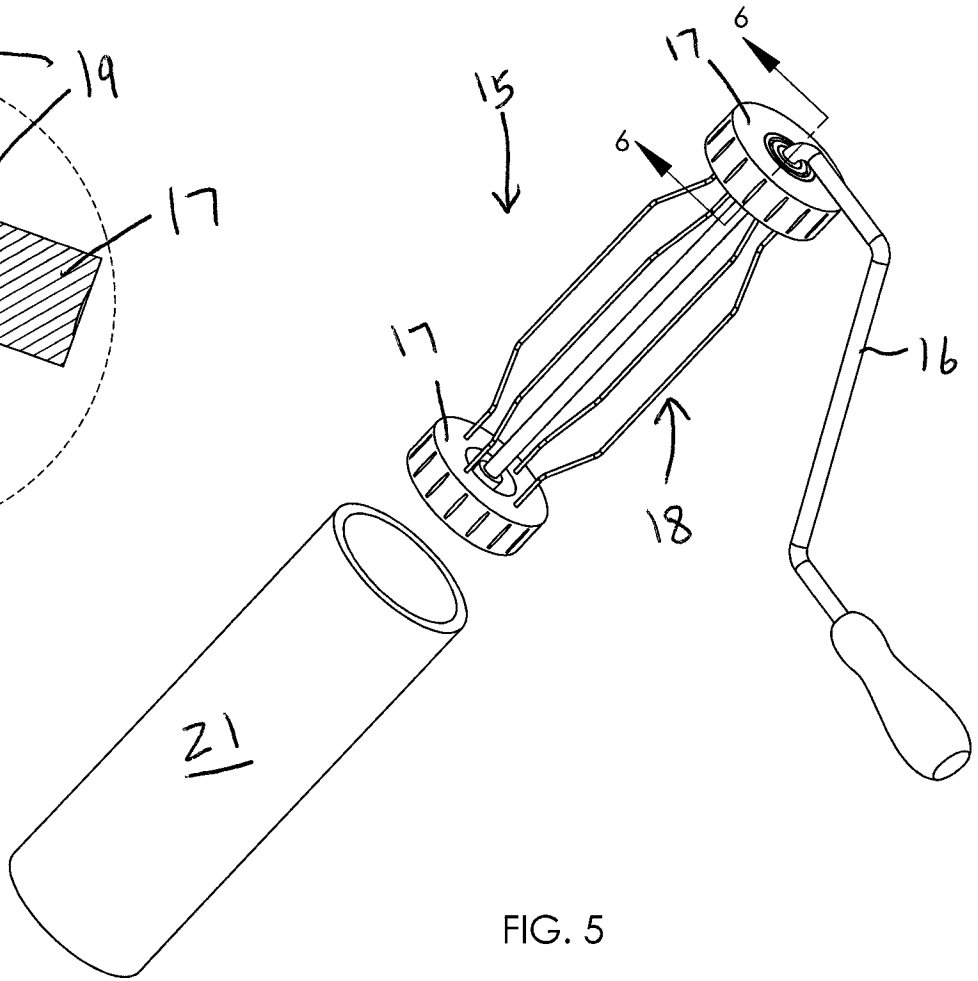
FIG. 5 is an exploded view of a paint roller with its head removed from its frame.
Figure 6:
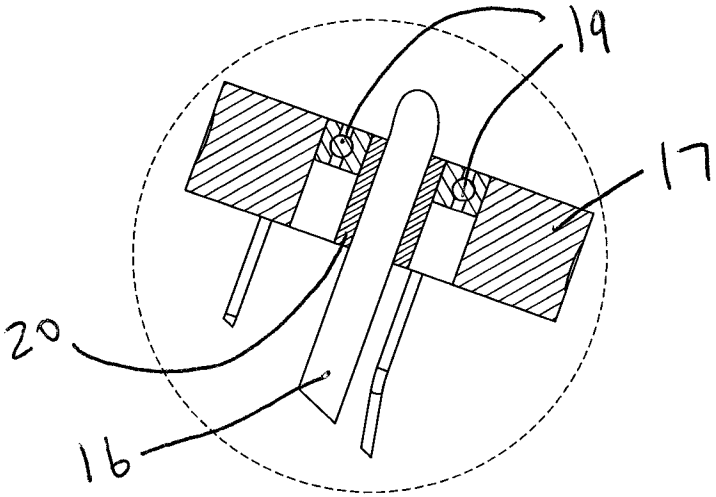
FIG. 6 is an enlarged cross-sectional view taken along line 6-6 in FIG. 5, showing bearing intercalated between a rubber sleeve and an end cap of the paint roller frame.

The combined apparatus 10 of this invention is referred to generally in FIGS. 1-6 and is intended to provide a combined paint roller 15 and paint roller cleaner 11 (collective referred to at 10) for quickly and effectively removing paint from the paint roller 15 without splashing fluids outwardly and away from the paint roller cleaner 11. It should be understood that the present invention may be used to clean many different types of paint rollers and the like, and should not be limited to the uses described herein.

A combined paint roller and paint roller cleaner 10 for quickly and efficient removing paint from the paint roller 15 while preventing fluids from splashing outwardly and away from the paint roller cleaner 11. These and other objects, features, and advantages of embodiments are provided by a combined paint roller and paint roller cleaner 10 preferably including a portable paint roller cleaner 11 and a paint roller 15 removably inserted into the paint roller cleaner 11.

In a non-limiting exemplary embodiment, the paint roller cleaner 11 preferably includes a main chamber 12 having a first slot 27 formed at an outer surface thereof, and an auxiliary chamber 13 statically coupled to the main chamber 12. Such an auxiliary chamber 13 protrudes outwardly from the outer surface of the main chamber 12 and preferably has an outer surface provided with a second slot 28 formed therein. Notably, the second slot 28 may be offset from the first slot 27 in such a manner that an external fluid stream, after passing through the first 27 and second 28 slots, is caused to enter the main chamber 12 at a non-perpendicular angle relative to the outer surface of the main chamber 12 and thereby rotate a portion of the paint roller 15 located within the paint roller cleaner 11 (as perhaps best shown in FIG. 3). Each of the main and auxiliary chambers 11, 15 may have a hollow interior (shown throughout the figures). Such a structural configuration provides the unexpected and unpredictable advantage of ensuring a user can quickly and effectively remove paint from the paint roller 15 and thereby direct discharge fluids without creating a mess.

In a non-limiting exemplary embodiment, the main chamber 12 may have a closed distal end 32 and an open proximal end 31.

In a non-limiting exemplary embodiment, the paint roller 15 preferably includes a handle 16, a support frame 18 attached to the handle 16, and a roller head 21 removable engaged about the support frame 18. In this manner, the support frame 18 and the roller head 21 may be inserted into the main chamber 12 and spaced inwardly from the auxiliary chamber 13.

In a non-limiting exemplary embodiment, the main chamber 12 may have a single and unitary body 40.

In a non-limiting exemplary embodiment, the main chamber 12 may have a bifurcated body 41 provided with first and second halves 42, 43 pivotally coupled to each other. Such a structural configuration provides the unexpected and unpredictable advantage of allowing a user to easily open up the main chamber 12 and thereby intercalate handle 16 between plates 22, 23 (further explained hereinbelow).

In a non-limiting exemplary embodiment, the paint roller cleaner 11 may further include first and second planar plates 22, 23 statically coupled to the first and second halves 42, 43, respectively. Such first and second planar plates 22, 23 may be registered parallel to each other and extend outwardly away from the main chamber 12. In this manner, the handle 16 is intercalated between the first and second plates 22, 23 and thereby maintained at a substantially stable position while the roller head 21 is rotatably disposed within the main chamber 12. Such an embodiment may be referred to as a split case chamber 12 employing hinges 33 for connecting halves 42, 43 together such that the handle 16 may be clamped between plates 22, 23. Rubber strips 24 may be used to frictionally clamp handle 16 when in use. Such a structural configuration provides the unexpected and unpredictable advantage of ensuring the paint roller 15 does not undesirably oscillate while receiving a jet stream of water during cleaning procedures.

In a non-limiting exemplary embodiment, the first and second slots 27, 28 may be linear and extend parallel to a longitudinal length of the main and auxiliary chamber 12, 13, respectively. Such a structural configuration provides the unexpected and unpredictable advantage of preventing discharge water from rebounding off the paint roller head 21 and egressing from the second slot 28.

In a non-limiting exemplary embodiment, the auxiliary chamber 13 may be closed at distal and proximal ends 29, 30 respectively for directing the fluid into the main chamber 12 via the first slot 27. Such a structural configuration provides the unexpected and unpredictable advantage of ensuring water does not laterally shoot out of the auxiliary chamber 13 during cleaning procedures.

In a non-limiting exemplary embodiment, the roller head 21 is preferably caused to rotate within the main chamber 12 during cleaning procedures while the handle 16 remains stationary. Such a structural configuration provides the unexpected and unpredictable advantage of preventing undesirable oscillation of the paint roller 15 during cleaning procedures.

An exemplary embodiment of the present disclosure may include a method of utilizing a combined paint roller and paint roller cleaner 10. Such a method may include the initial step of: providing a portable paint roller cleaner 11 having a main chamber 12 provided with a first slot 27 formed at an outer surface thereof, and an auxiliary chamber 13 statically coupled to the main chamber 12. Such an auxiliary chamber 13 protrudes outwardly from the outer surface of the main chamber 12 and has an outer surface provided with a second slot 28 formed therein. Each of the main and auxiliary chambers 12, 13 preferably has a hollow interior. A second chronological step may include: providing and removably inserting the paint roller 15 into the paint roller cleaner 11. Notably, the second slot 28 is offset from the first slot 27 in such a manner that an external fluid stream, after passing through the first and second slots 27, 28, is caused to enter the main chamber 12 at a non-perpendicular angle relative to the outer surface of the main chamber 12 and thereby rotate a portion of the paint roller located within the paint roller cleaner 11.

Referring to the FIGS. 1-6 in general, the first slot 27 and second slot 28 may be configured in such a manner that water is forcefully jetted into the main chamber 12 by passing through the smaller auxiliary chamber 13 at an oblique angle. In this way, the ingressing water engages the paint roller head 21 at a substantially tangential angle and thereafter rebounds to escape from the main chamber 12 via the open proximal end 31 thereof. In this manner, there is no need to have a seal for the jetted water entering the main chamber 12.

In a non-limiting exemplary embodiment, the handle 16 may be suitably dimensioned to conform to the shape of the arm 53 of the paint roller 15. It is envisioned that the handle 16 may be detachable to allow adaption of the paint roller 15 to various sizes of rollers by using a series of handles, for example. The frame 18 may include a series of wires anchored at opposite ends via end caps 17, thru which handle 16 passes. Bearings 19 are intercalated between the end caps 17 and a rubber sleeve 20 that engages the handle 16. Thus, the frame is rotatable relative to the handle 16.

A hose 26 may be attached to a water faucet and placed above a sink with the combined paint roller cleaner and paint roller 10. The roller head 21 may be inserted in the main chamber 12 with the open end 31 of the main chamber 12 facing downwards into the sink. Next, the user may turn on the faucet and preferably move the hose up and down the length of the first and second slots 27, 28. In this way, the force of the water jet cleans the roller head 21 as it tangentially engages same within the main chamber 12.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the non-limiting exemplary embodiments may include variations in size, materials, shape, form, function and manner of operation.

What is claimed as new and what is desired to secure by Letters Patent of the United States is:

1. A combined paint roller and paint roller cleaner comprising:

a paint roller cleaner and a paint roller removably inserted into said paint roller cleaner;

wherein said paint roller cleaner comprises a main chamber having a first slot formed at an outer surface thereof, and an auxiliary chamber protruding outwardly from said outer surface of said main chamber, said auxiliary chamber having an outer surface provided with a second slot formed therein;

wherein said second slot is offset from said first slot in such a manner that an external fluid stream, after passing through said first and second slots, is caused to enter said main chamber at a non-perpendicular angle relative to said outer surface of said main chamber and thereby rotate a portion of said paint roller located within said paint roller cleaner.

2. The combined paint roller and paint roller cleaner of claim 1, wherein said main chamber has a closed distal end and an open proximal end.

3. The combined paint roller and paint roller cleaner of claim 1, wherein said paint roller comprises:

a handle;

a support frame attached to said handle;

a roller head removable engaged about said support frame;

wherein said support frame and said roller head are inserted into said main chamber and spaced inwardly from said auxiliary chamber.

4. The combined paint roller and paint roller cleaner of claim 3, wherein said roller head is caused to rotate within said main chamber during cleaning procedures while said handle remains stationary.

5. The combined paint roller and paint roller cleaner of claim 1, wherein said main chamber has a single and unitary body.

6. The combined paint roller and paint roller cleaner of claim 1, wherein said main chamber has a bifurcated body including first and second halves pivotally coupled to each other.

7. The combined paint roller and paint roller cleaner of claim 5, further comprising:

first and second planar plates statically coupled to said first and second halves respectively, said first and second planar plates being registered parallel to each other and extending outwardly away from said main chamber;

wherein said handle is intercalated between said first and second plates and thereby maintained at a substantially stable position while said roller head is disposed within said main chamber.

8. The combined paint roller and paint roller cleaner of claim 1, wherein said first and second slots are linear and extend parallel to a longitudinal length of said main and auxiliary chambers respectively.

9. The combined paint roller and paint roller cleaner of claim 1, wherein said auxiliary chamber has closed distal and proximal ends respectively for directing the fluid into said main chamber via said first slot.

10. A combined paint roller and paint roller cleaner comprising:

a portable paint roller cleaner and a paint roller removably inserted into said paint roller cleaner;

wherein said paint roller cleaner comprises a main chamber having a first slot formed at an outer surface thereof, and an auxiliary chamber statically coupled to said main chamber and protruding outwardly from said outer surface of said main chamber, said auxiliary chamber having an outer surface provided with a second slot formed therein;

wherein said second slot is offset from said first slot in such a manner that an external fluid stream, after passing through said first and second slots, is caused to enter said main chamber at a non-perpendicular angle relative to said outer surface of said main chamber and thereby rotate a portion of said paint roller located within said paint roller cleaner;

wherein each of said main and auxiliary chambers has a hollow interior.

11. The combined paint roller and paint roller cleaner of claim 10, wherein said main chamber has a closed distal end and an open proximal end.

12. The combined paint roller and paint roller cleaner of claim 10, wherein said paint roller comprises:

a handle;

a support frame attached to said handle;

a roller head removable engaged about said support frame;

wherein said support frame and said roller head are inserted into said main chamber and spaced inwardly from said auxiliary chamber.

13. The combined paint roller and paint roller cleaner of claim 12, wherein said roller head is caused to rotate within said main chamber during cleaning procedures while said handle remains stationary.

14. The combined paint roller and paint roller cleaner of claim 10, wherein said main chamber has a single and unitary body.

15. The combined paint roller and paint roller cleaner of claim 10, wherein said main chamber has a bifurcated body including first and second halves pivotally coupled to each other.

16. The combined paint roller and paint roller cleaner of claim 15, further comprising:

first and second planar plates statically coupled to said first and second halves respectively, said first and second planar plates being registered parallel to each other and extending outwardly away from said main chamber;

wherein said handle is intercalated between said first and second plates and thereby maintained at a substantially stable position while said roller head is disposed within said main chamber.

17. The combined paint roller and paint roller cleaner of claim 10, wherein said first and second slots are linear and extend parallel to a longitudinal length of said main and auxiliary chambers respectively.

18. The combined paint roller and paint roller cleaner of claim 10, wherein said auxiliary chamber has closed distal and proximal ends respectively for directing the fluid into said main chamber via said first slot.

19. A method of utilizing a combined paint roller and paint roller cleaner, said method comprising the chronological steps of:

providing a portable paint roller cleaner comprising a main chamber having a first slot formed at an outer surface thereof, and an auxiliary chamber statically coupled to said main chamber and protruding outwardly from said outer surface of said main chamber, said auxiliary chamber having an outer surface provided with a second slot formed therein, each of said main and auxiliary chambers having a hollow interior;

providing and removably inserting said paint roller into said paint roller cleaner;

wherein said second slot is offset from said first slot in such a manner that an external fluid stream, after passing through said first and second slots, is caused to enter said main chamber at a non-perpendicular angle relative to said outer surface of said main chamber and thereby rotate a portion of said paint roller located within said paint roller cleaner.

* * * * *